United States Patent [19]

Wheeler

[11] 4,086,803

[45] May 2, 1978

[54] PIPE BENDING MANDREL

[75] Inventor: Lionel H. Wheeler, Houston, Tex.

[73] Assignee: CRC-Crose International, Inc., Houston, Tex.

[21] Appl. No.: 759,574

[22] Filed: Jan. 14, 1977

Related U.S. Application Data

[63] Continuation-in-part of Ser. No. 699,666, Jun. 25, 1976, abandoned.

[51] Int. Cl.[2] ..... B21D 9/03

[52] U.S. Cl. ..... 72/466

[58] Field of Search ..... 72/393, 466, 479; 269/48.1; 279/2 R

[56] References Cited

U.S. PATENT DOCUMENTS

| | | | |
|---|---|---|---|
| 856,896 | 6/1907 | McCormick | 72/393 |
| 2,380,344 | 7/1945 | Sutton | 72/466 |
| 2,734,120 | 2/1956 | Sensenig | 269/48.1 |
| 2,734,749 | 2/1956 | Benjamin | 279/2 R |
| 2,835,498 | 5/1958 | Howes | 279/2 R |
| 3,115,798 | 12/1963 | Donaway | 279/2 R |
| 3,117,797 | 1/1964 | Buck | 279/2 R |
| 3,383,723 | 5/1968 | Connelly | 279/2 R |
| 3,747,394 | 7/1973 | Cunningham | 72/466 |

FOREIGN PATENT DOCUMENTS

| | | | |
|---|---|---|---|
| 288,498 | 1/1971 | U.S.S.R. | 279/2 R |

*Primary Examiner*—Lowell A. Larson

*Attorney, Agent, or Firm*—Richards, Harris & Medlock

[57] ABSTRACT

A pipe bending mandrel having a housing assembly of a plurality of interconnected, axially aligned segmented housing subassemblies, each of which has an internal taper, a plurality of spherical members spaced along a tension member and adapted to coact with the internal housing tapers, a plurality of axially extending flexible strips connected to the housing segments, and an actuator connected to the spherical members and the housings to move the spherical members into the internal housing tapers to expand the housings into pipe supporting position within a pipe to be bent. Suitable wheels are provided for moving the mandrel into, through and out of the pipe.

11 Claims, 7 Drawing Figures

Fig. 4
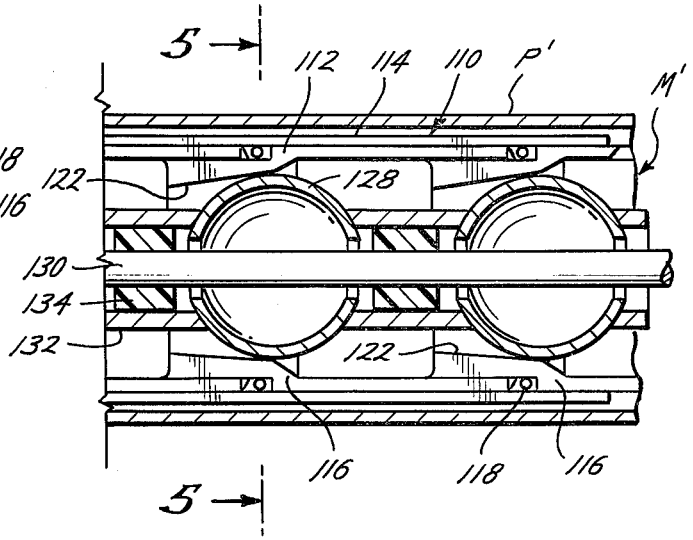
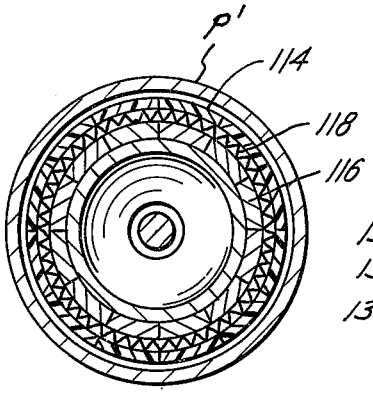
Fig. 5
Fig. 6
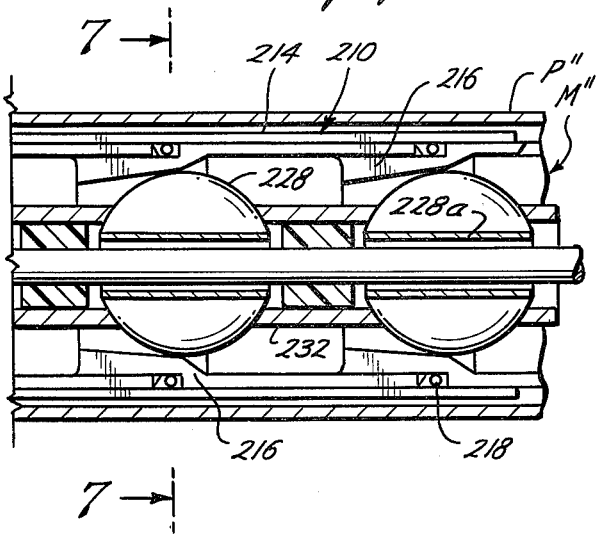
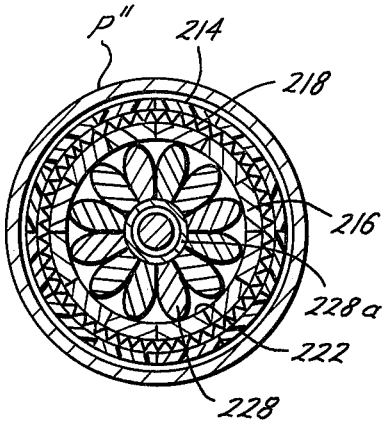
Fig. 7

PIPE BENDING MANDREL

CROSS-REFERENCE TO RELATED APPLICATIONS

This application is a continuation-in-part application of my prior copending application Ser. No. 699,666, filed June 25, 1976 and now abandoned.

BACKGROUND OF THE INVENTION

It has long been common practice to provide an internal support for pipe while the pipe is being bent to avoid wrinkling and other non-uniformities in the pipe normally resulting from the bending of pipe without adequate internal support during bending. One of the problems encountered in bending mandrels is the adjustments which have to be made as a result of slight variations in the diameter of the pipe. Most prior art mandrels have used actuators with a past-center type of expander so that the outside diameter of the expanded mandrel is a single dimension and even though some accommodation is provided by having resilient pads engaging the pipe interior, all but the most minor changes in diameter require some shimming.

U.S. Pat. No. 2,401,052 dated May 28, 1964 to J. D. Cummings, No. 3,043,361 dated July 10, 1962 to C. L. Kelso and No. 3,109,477 dated Nov. 5, 1963 to T. W. Avera are examples of pipe bending mandrels of the prior art.

SUMMARY

The present invention relates to an improved pipe bending mandrel to provide internal support for a pipe while the pipe is being bent.

An object of the present invention is to provide an improved pipe bending mandrel which will provide adequate internal support for pipe during bending even though the internal diameter of the pipe varies substantially from the expected or nominal internal diameter.

Another object of the present invention is to provide an improved internal pipe bending mandrel which is inexpensive to manufacture, simple to operate and requires a minimum of service maintenance.

The present invention relates to an improved pipe bending mandrel which includes a plurality of axially aligned connected subassemblies each having a plurality of segments with internal tapers, a tension member having a plurality of spherical members secured along the tension member and an actuator connected to the subassemblies and the tension member to move the spherical members against the tapers to expand the subassemblies into pipe supporting position.

BRIEF DESCRIPTION OF THE DRAWINGS

These and other objects and advantages of the present invention are hereinafter set forth and explained with reference to the drawings wherein:

FIG. 4 is a partial longitudinal sectional view of a modified form of the present invention.

FIG. 5 is a transverse sectional view taken along line 5—5 in FIG. 4.

FIG. 6 is a partial longitudinal sectional view of another modified form of the present invention.

FIG. 7 is a transverse sectional view taken along line 7—7 in FIG. 6.

DESCRIPTION OF THE PREFERRED EMBODIMENT

Figure 3:
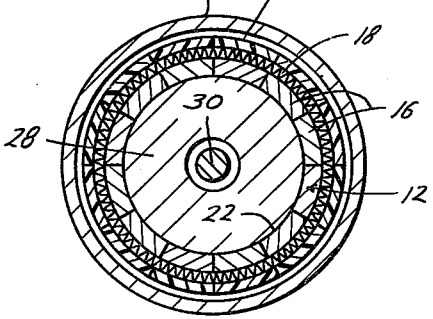
FIG. 3 is a sectional view taken along line 3—3 in FIG. 2.

The improved internal pipe bending mandrel M is shown in the drawings within the pipe P and includes a housing 10 comprising a plurality of longitudinally segmented housing subassemblies 12 and a plurality of longitudinally extending support strips 14 secured to the exterior of the individual segments or elements 16 of the housing subassemblies 12 as best seen in FIG. 3.

The external diameter of the forward end of each of the housing subassemblies 12 is smaller than the internal diameter of the rearward end of each of the subassemblies 12 so that each of the subassemblies 12 nest one within the next adjacent subassembly as shown. The garter springs 18 are positioned around the exterior of the reduced diameter portion of each of the housing subassemblies 12 near the shoulders 20 to urge the segments 16 of each subassembly 12 into their retracted position.

The interior of each of the segments 16 includes a tapered surface 22 which, when the subassemblies 12 are completely assembled, tapers inward and forward. The rearmost of the subassemblies 12 has its segments 16 forming the external groove 24. The garter spring 26 is positioned within the groove 24 and urges the segments of this rear subassembly into retracted position.

Coacting with the subassemblies 12 are a series of expansion means. This series of expansion means as shown includes the spherical members 28 which are positioned in spaced relationship to each other on the elongate tension element 30. Tension element 30 is at least partially flexible, such as a cable, so that it can accommodate to the flexing when the mandrel M is within a pipe during bending. The spherical members 28 are spaced apart by the sleeves 32 which surround the tension element 30 and abut the spherical members 28. The length of sleeves 32 is preselected to provide the desired spacing of spherical members 28 so that each spherical member 28 is positioned substantially identically with respect to the tapered surfaces 22 of its subassembly 12. The flexible collars 34 are positioned within the sleeves 32 surrounding the tension member 30. These collars 32 generally tend to center the tension member 30 within the sleeves 32 while allowing the mandrel M to assume a supporting contour with respect to the interior of the pipe as it is bent. The collars 34 are preferably made of a resilient material such as polyurethane.

The inner or forward end of the elongate tension member 30 has a support collar 36 secured between the partial sleeve 38 and the fastening means 40. The brackets 42 are secured to the exterior of collar 36 and provide support for the wheels 44. The outer or rear end of the elongate tension member 30 has the support collar 46 mounted thereon in a position abutting the partial sleeve 48. The wheels 50 mounted on the brackets 52 together with wheels 44 allow the mandrel M to be rolled into, through and out of the pipe P.

The mandrel M is expanded into pipe supporting position by the actuator 54. The actuator 54 includes the cylinder 56 having a piston 58 which may reciprocate therein, supply line 60, vent line 62, inner cylinder line 64, outer cylinder line 66 and valve 68 which controls the supply of actuating fluid to one end of cylinder 56 while venting the other end. The piston 58 is suitably connected to the rear end of tension member 30. The flange 70 is secured to the forward end of cylinder 56 and is secured in groove 72 defined in the interior of the outer of the subassemblies 12 to provide the connection between the actuator 54 and the expansible subassemblies 12. The valve 68 is coontrolled by the arm 74 which is sufficiently long to extend to the exterior of the pipe being bent. Thus, as the piston 56 reciprocates within the cylinder 56 relative movement is imparted to the spherical members 28 with respect to the taper surfaces 22 on the segments 16.

Figure 1:
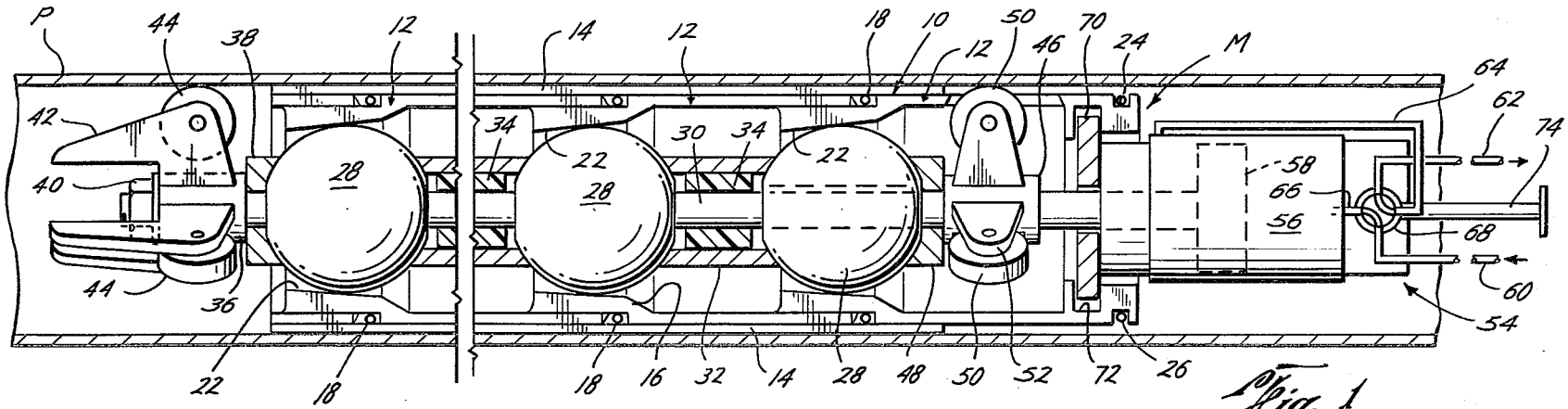
FIG. 1 is a longitudinal sectional view of the improved bending mandrel of the present invention showing the mandrel in its extended pipe supporting position.
Figure 2:
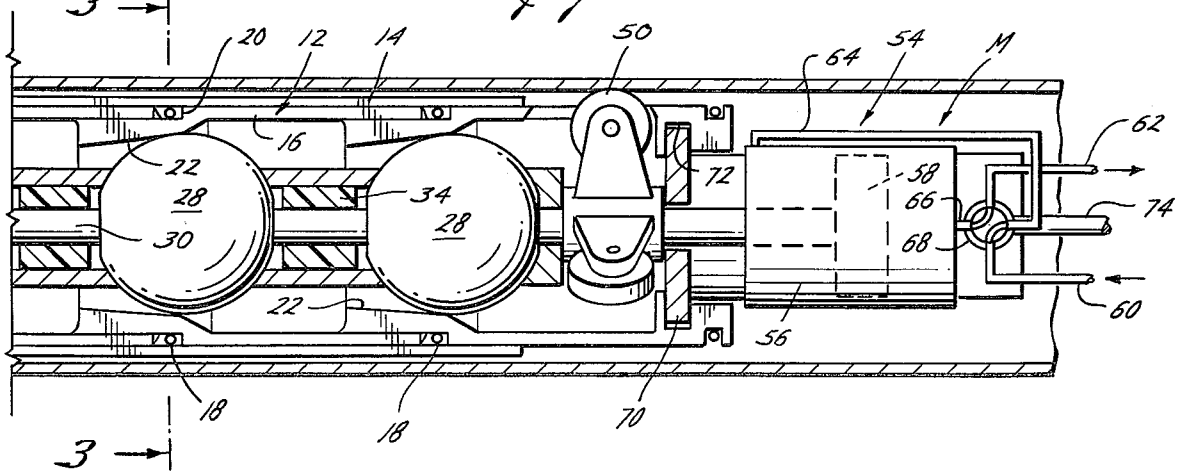
FIG. 2 is a partial sectional view similar to FIG. 1 showing the mandrel in its retracted position.

In operation, the mandrel M, with its components positioned as shown in FIG. 2, is rolled into the pipe P which is to be bent. The mandrel M is supported on the wheels 44 and 50 for ease of movement. When the mandrel M is positioned within the pipe P at the desired location to properly support the pipe P during bending, the mandrel M is moved into pipe supporting position shown in FIG. 1. Movement of mandrel M in the pipe P may be controlled by the arm 74 or other suitable means. The arm 74 may be rotated to operate the valve 68 so that it is free to pull or push the mandrel M in its movement within pipe P.

The mandrel M is moved to pipe supporting position by actuation of valve 68. During movement of mandrel M into the pipe P, the valve 68 is positioned to be shut off or to vent pressure from the rear end of the cylinder 56 and to supply pressure to the forward end of cylinder 56. In this position of valve 68, the piston 58 is held in its rearward position and the garter springs 20 and 26 assure that the subassemblies 12 are retained in their retracted position. With the mandrel M positioned for expansion, the valve 68 is turned to connect supply line 60 with line 66 whereby pressure is supplied to the rear end of the cylinder 56. This position of valve 68 also places line 64 in communication with vent line 62 so that the forward end of cylinder 56 is vented. With pressure in cylinder 56 at its rear end, piston 58 is urged forward. The force on piston 58 causes it to move in cylinder 56 and to move spherical members 28 on the internal tapers 22 wedging the segments 16 and strips 14 outward. This movement continues until the subassemblies 12 are expanded into pipe supporting position within the pipe P. The pipe supporting position of mandrel M has the strips 14 in firm engagement with the interior of pipe P along their length. The spacing of spherical members 28 along tension member 30 and the spacing of the subassemblies 12 is carefully preselected so that the spherical members 28 are each always in substantially the same relative position with respect to their tapered surface 22. This assures that each of the subassemblies 12 is expanded at the same time and to substantially the same outer diameter.

When bending has been completed, the mandrel M is removed to its retracted position by reversing the position of valve 68 so that the rear end of the cylinder 56 is vented and the forward end is pressurized. This moves piston 58 rearwardly in cylinder 56 and moves spherical members 28 out from under the tapered surfaces 22. With the support for the expansion of the subassemblies 12 removed, the garter springs 18 and 24 move the segments 16 to their retracted position. The mandrel M can then be moved to a new position for supporting additional bending of the same pipe P or may be removed from the pipe P if the bending operations have been completed.

If desired the mandrel M may be provided with a drive wheel (not shown) and suitable controls which will allow it to be moved within the pipe P under power and to be remotely controlled. Such drive wheels and controls are well known in the art.

In the modified form of the improved mandrel of the present invention shown in FIGS. 4 and 5, the spherical members 28 have been replaced by an annular ring 128 having an arcuate contour in longitudinal section as shown in FIG. 4. This modified mandrel M′ is shown within the pipe P′ and in addition to the ring 128 it includes the housing 110 comprising a plurality of longitudinally segmented subassemblies 112 and a plurality of strips 114 extending longitudinally and being secured to the exterior of the segments 116. The spring 118 urges the subassemblies 112 inwardly and the ring 128 coacts with the inner tapered surfaces 122 so that relative movement of the ring 128 to the left in FIG. 4 expands the subassemblies outward into supporting position within the pipe P′.

The modified mandrel M″ shown in FIGS. 6 and 7 is similar in all respects to the other two forms except the portion of the structure which acts upon the tapered surfaces 222 of the segments 216 includes a series of arcuate projections 228 (one for each segment 216) mounted on a tube **228*a*. The projections have the arcuate shape shown in FIG. 6 which is substantially the same as the sectional shapes of the spherical members 28 and the ring 128**. All three forms of this invention function in the same manner.

With the use of the present invention, the pipe which is to be internally supported thereby for bending may vary in internal diameter a fairly substantial amount and still be accommodated by the mandrel M. With larger increases in diameter over that shown in FIG. 1, the piston 58 will continue to urge the spherical members 28 along the tapered surfaces 22 until the strips 14 are pressed into tight engagement with the interior of the pipe P. Thus, movement of the piston 28 continues until there is sufficient resistance to movement by the engagement of strips 14 on the interior of pipe P to develop the same forces against the piston movement as there are urging the piston to move.

The mandrel M which uses the wedging action of the spherical members 28 for expansion can accommodate very substantial differences in pipe sizes without sacrificing adequate internal support. The spherical members 28 move on the tapered surfaces 22 until there is a resistance to expansion developed by engagement of the strips 14 with the pipe interior which matches the wedging forces. The improved mandrel is easy to operate and will be relatively maintenance free.

What is claimed is:

1. A pipe supporting mandrel comprising:

a plurality of generally tubular shaped housing assemblies connected in end-to-end relationship, each of said housing assemblies comprising a plurality of segments having a tapered interior surface;

a plurality of members, each of said members positioned within one of said segmented housing assemblies to engage the tapered surface thereof;

means for interconnecting said members to position each of said members in substantially the same relative position with respect to its respective segmented housing assembly; and means for simultaneously moving said members relative to their respective segmented housing assemblies between a first position wherein said members force said segments outwardly into a pipe supporting position and a second position wherein said members allow said segments to inwardly retract.

2. A pipe supporting mandrel according to claim 1, including means for controlling said moving means within a pipe from the exterior of the pipe.

3. A pipe supporting mandrel according to claim 1, including a plurality of resilient strips extending longitudinally and connecting to the segments of each of said segmented housing assemblies.

4. A pipe supporting mandrel according to claim 1, wherein said interconnecting means is a flexible elongate tension member, and said members are mounted in spaced relationship to each other along said elongate tension member.

5. A pipe supporting mandrel according to claim 1, wherein said moving means is an actuator including a piston movable within a cylinder and a control valve for alternately directing pressure to the ends of the cylinder and venting the opposite end, said piston being connected to said elongate tension member and said cylinder being connected to said segmented housing assemblies.

6. A pipe supporting mandrel according to claim 1, including means for urging the segments of each housing assembly inwardly to a retracted position from the pipe supporting position when said members are moved to said second position.

7. A pipe supporting mandrel according to claim 1, wherein said members are spherical.

8. A pipe supporting mandrel according to claim 1, wherein said members are arcuate.

9. A pipe supporting mandrel according to claim 8, wherein each of said arcuate members is a ring.

10. A pipe supporting mandrel according to claim 8, wherein each of said arcuate members comprises a tubular member having a plurality of uniformly dimensioned, radially extending projections mounted thereon.

11. A pipe supporting mandrel according to claim 6, wherein said urging means is a garter spring disposed around the exterior of each of said segmented housing assemblies.

* * * * *